US011752550B2

(12) United States Patent
Bishop et al.

(10) Patent No.: US 11,752,550 B2
(45) Date of Patent: Sep. 12, 2023

(54) METHOD FOR IMPROVING FATIGUE STRENGTH ON SIZED ALUMINUM POWDER METAL COMPONENTS

(71) Applicant: GKN Sinter Metals, LLC, Auburn Hills, MI (US)

(72) Inventors: Donald Paul Bishop, Stillwater Lake (CA); Matthew D. Harding, Bedford (CA); Richard L. Hexemer, Jr., Granite Falls, NC (US); Ian W. Donaldson, Madison, NH (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 140 days.

(21) Appl. No.: 16/244,406

(22) Filed: Jan. 10, 2019

(65) Prior Publication Data

US 2019/0210112 A1 Jul. 11, 2019

Related U.S. Application Data

(60) Provisional application No. 62/615,799, filed on Jan. 10, 2018.

(51) Int. Cl.
*B22F 3/24* (2006.01)
*B22F 3/16* (2006.01)
(Continued)

(52) U.S. Cl.
CPC ..... *B22F 3/24* (2013.01); *B22F 3/14* (2013.01); *B22F 3/16* (2013.01); *B22F 3/162* (2013.01);
(Continued)

(58) Field of Classification Search
CPC ..... C22F 1/04–057; B22F 2003/248; B22F 2003/166
See application file for complete search history.

(56) References Cited

U.S. PATENT DOCUMENTS 4,992,117 A 2/1991 Okubo et al.
5,176,740 A * 1/1993 Miura ..... C22C 1/0416 420/529
(Continued)

FOREIGN PATENT DOCUMENTS

CN 105234411 A 1/2016
CN 105234412 A 1/2016
(Continued)

OTHER PUBLICATIONS

Samal P. and Newkirk J. "Conventional Powder Metallurgy Aluminum Alloys"; ASM Handbook; vol. 7, 2015 (Year: 2015).*
(Continued)

*Primary Examiner* — Kevin E Yoon
*Assistant Examiner* — Austin Pollock
(74) *Attorney, Agent, or Firm* — Quarles & Brady LLP

(57) ABSTRACT

A method of manufacturing a sized powder metal component having improved fatigue strength. The method includes the sequential steps of solutionizing a sintered powder metal component and quenching the sintered powder metal component, sizing the sintered powder metal component to form a sized powder metal component, re-solutionizing the sized powder metal component, and ageing the sized powder metal component. The sized powder metal component made by this method, in which the component is re-solutionized between sizing before ageing, can exhibit exceptional improvements in fatigue strength compared to components prepared similarly but that are not re-solutionized.

19 Claims, 3 Drawing Sheets

(51) Int. Cl.

| | |
|---|---|
| ***C22C 1/04*** | (2023.01) |
| ***B22F 3/14*** | (2006.01) |
| ***C22C 21/00*** | (2006.01) |
| ***C22F 1/04*** | (2006.01) |

(52) U.S. Cl.
CPC ..... *C22C 1/0416* (2013.01); *B22F 2003/166* (2013.01); *B22F 2003/247* (2013.01); *B22F 2003/248* (2013.01); *B22F 2201/50* (2013.01); *B22F 2301/052* (2013.01); *B22F 2303/15* (2013.01); *B22F 2998/10* (2013.01); *C22C 21/00* (2013.01); *C22F 1/04* (2013.01)

(56) References Cited

U.S. PATENT DOCUMENTS

| | | | | |
|---|---|---|---|---|
| 5,292,358 | A * | 3/1994 | Miura | C22C 21/00 420/529 |
| 5,976,214 | A * | 11/1999 | Kondoh | B22F 1/02 75/244 |
| 6,203,753 | B1 * | 3/2001 | Donaldson | B22F 1/0059 419/54 |
| 6,468,468 | B1 * | 10/2002 | Neubing | C22C 1/0416 419/38 |
| 10,427,216 | B2 | 10/2019 | Suzuki et al. | |
| 2005/0034559 | A1 * | 2/2005 | Lindenau | B22F 1/0003 75/249 |
| 2005/0036899 | A1 * | 2/2005 | Lindenau | B22F 3/12 419/38 |
| 2005/0079085 | A1 * | 4/2005 | Ichikawa | C22C 21/10 419/28 |
| 2006/0013719 | A1 * | 1/2006 | Ichikawa | C22C 32/0047 419/29 |
| 2016/0214174 | A1 * | 7/2016 | Suzuki | C22C 1/0416 |

FOREIGN PATENT DOCUMENTS

| | | | | |
|---|---|---|---|---|
| CN | 106270541 | A | | 1/2017 |
| CN | 106435417 | A | | 2/2017 |
| JP | 2247348 | A | | 10/1990 |
| JP | 04308050 | A | * | 10/1992 |
| JP | 09025524 | A | * | 1/1997 |
| JP | 2009242883 | A | | 10/2009 |
| JP | 5082483 | B2 | | 11/2012 |
| JP | 2015067843 | A | | 4/2015 |
| JP | 2015068185 | A | | 4/2015 |

OTHER PUBLICATIONS

ASM Handbook, "Fatigue", Chapter 14, "Elements of Metallurgy and Engineering Alloys", 2008 (Year: 2008).*

Sprague J. and Smidt F.; "Surface Engineering of Aluminum and Aluminum Alloys", ASM Handbook, vol. 5 (Year: 1994).*

Vargel C.; "Corrosion of Aluminum", Chapter A.3 "The Metallurgy of Aluminum", p. 48-57, 2004 (Year: 2004).*

Forging.com; "Finishing Operations", Retrieved Jun. 9, 2021, https://www.forging.org/forging/design/533-finishing-operations.html (Year: 2021).*

Library of Manufacturing; "Sizing", Retrieved Jun. 9, 2021, https://www.thelibraryofmanufacturing.com/sizing.html, Wayback Machine date Feb. 27, 2013 (Year: 2013).*

KimberMills International; "Processes Coining"; https://www.kimbermills.co.uk/processes/coining/; Retrieved from the internet on Jan. 26, 2021; Aug. 3, 2017 (Year: 2017).*

Behren B.A.; "Cold Sizing of Cold and Hot-Formed Gears"; Institute for Metal Forming and Metal Forming Machine Tools; 2004 (Year: 2004).*

Parker G., "Encyclopedia of Materials: Science and Technology", 2001, pp. 111-113 (Year: 2001).*

Mackenzie S.; "Heat Treatment of Aluminum VI—Artificial Aging"; https://thermalprocessing.com/heat-treatment-of-aluminum-vi-artificial-aging/; retrieved from internet on Sep. 23, 22; 2021 (Year: 2021).*

Lee P.W., et al; ASM Handbook, vol. 7: Powder Metal Technologies and Applications; p. 834-839; "Conventional Aluminum Powder Metallurgy Alloys'"; 1998 (Year: 1998).*

Harding et al., Effects of Post-Sinter Processing on an Al—Zn—Mg—Cu Powder Metallurgy Alloy, Metals, 2017, 7:370, 17 pages.

China National Intellectual Property Administration, First Office Action and Search Report, Application No. 201910019361.3, dated Mar. 8, 2022, 20 pages.

Intellectual Property India, Examination Report, Application No. 201814047085, dated Mar. 28, 2022, 6 pages.

American Society for Metals, Metals Handbook: Failure Analysis and Prevention, 8th Edition, vol. 10, pp. 160-161, 1975 (4 pages, from Second Chinese Office Action cited below).

China National Intellectual Property Administration, Second Office Action and Search Report, Application No. CN 201910019361.3, dated Nov. 10, 2022, 24 pages.

Japan Patent Office, Notice of Reasons for Refusal, Application No. JP 2019-001721, dated Dec. 27, 2022, 9 pages.

* cited by examiner

METHOD FOR IMPROVING FATIGUE STRENGTH ON SIZED ALUMINUM POWDER METAL COMPONENTS

CROSS-REFERENCE TO RELATED APPLICATION

This application claims the benefit of the filing date of U.S. Provisional Patent Application No. 62/615,799 entitled "Method for Improving Fatigue Strength on Sized Aluminum Powder Metal Components" filed on Jan. 10, 2018, which is hereby incorporated by reference for all purposes as if set forth in its entirety herein.

STATEMENT OF FEDERALLY SPONSORED RESEARCH OR DEVELOPMENT

Not applicable.

FIELD OF THE INVENTION

This disclosure relates to a method for improving the fatigue strength on sized aluminum powder metal components.

BACKGROUND

Powder metallurgy is well adapted to parts requiring dimensional accuracy and having high production volumes. To produce powder metal parts, a powder metal is conventionally compacted in a tool and die set to form a compact which is held together by small amounts of wax or binder. The compact is ejected from the die and sintered under controlled atmosphere in a furnace at sintering temperatures which typically approach, but are below, the melting temperature of the main constituent of the powder metal. In some instances, a fractional liquid phase may also form, but in many instances the sintering is primarily driven by solid state diffusion in which adjacent particles neck into one another to reduce pore size and close pores between the particles as the compact is sintered into a sintered powder metal part. In some instances this sintering step may be pressure-assisted, but in many cases the sintering is not. As the compact is sintered to form the sintered powder metal part, there typically will be some dimensional shrinkage which—given variances in process parameters (e.g., sintering temperature)—can create some variance in the final sintered dimensions of the sintered powder metal part across a batch of prepared parts.

Accordingly, while such sintered powder metal parts already have very tightly controlled dimensions, in some instances, it may be necessary to perform additional steps to bring critical dimensions of parts to the desired target dimension and within the range of acceptable dimensional tolerance. To do this, known post-sintering secondary operations may be performed such as sizing or machining.

SUMMARY

When sizing is performed, this mechanical deformation can alter the mechanical properties of the part. Because many sintered parts also receive post-sintering heat treatment, the effect of sizing on mechanical properties can vary based on the order in which the heat treatment steps and sizing are performed.

For example, certain parts are solutionized (that is, heat treated to a temperature just below the liquidus to homogeneous the material) and subsequently artificially aged (that is, heated to low temperature for a length of time to build hardness and strength to achieve in the matter of hours which would take months if the parts were maintained at room temperature). Because parts become more ductile after being solutionized, they are more responsive to subsequent sizing processes where density and strength are enhanced. Thus, conventionally, if a powder metal part is to be sized, it is sized between solutionizing and ageing.

Disclosed herein is a modification to those post-sintering process steps which has been found to have surprising and unexpected results. It has been found that by injecting an additional step of re-solutionizing the part between the steps of sizing and ageing in a solutionizing-sizing-ageing progression, that significant improvements in fatigue strength of the sized part can be realized (in some cases upwards of 20% improvement over non-re-solutionized parts).

According to one aspect, a method is disclosed of manufacturing a sized powder metal component having improved fatigue strength. First, a sintered powder metal component is solutionized and quenched. Then, the sintered powder metal component is sized to form a sized powder metal component. The sized powder metal component is re-solutionized. After being re-solutionized, the sized powder metal component is aged.

The fatigue strength of the sized powder metal component can be improved by the step of re-solutionizing the sized powder metal component after the step of sizing (and before the step of ageing) in comparison to an identical sized powder metal component that has been solutionized, sized, and aged without being additionally re-solutionized between being sized and aged.

In some forms, the method may further include, before the step of solutionizing the sintered powder metal component, the steps of compacting a powder metal to form a powder metal compact and sintering the powder metal compact to form the sintered powder metal component. In some forms, the compacting and sintering may occur sequentially as discrete steps.

In other forms, the method may again include compacting a powder metal to form a powder metal compact and sintering the powder metal compact to form the sintered powder metal component; however, the step of solutionizing the sintered powder metal component may occur during the step of sintering. In this way, a separate pre-sizing solutionizing step apart from the sintering step may not be present, because some solutionizing can occur during the sintering step. Put differently, it is contemplated that sintering and the first solutionizing step may happen contemporaneously with one another or could be sequenced.

In some forms, the sintered powder metal component may be an aluminum alloy. It is contemplated the method may also be applicable to other non-aluminum alloy powder metal compositions; however, because of the nature of the method (i.e., it includes solutionizing and ageing steps) it is contemplated that regardless of the particular base material, the material will be an alloy and not a substantially pure material.

In some forms of the method, one or both of the steps of solutionizing and re-solutionizing occur at a solutionizing temperature over a solutionizing time during which steps grains of the sintered powder metal component form a homogeneous solid solution. It is contemplated that the solutionizing temperatures and times for the solutionizing step and the re-solutionizing step could be the same or different. According to one set of parameters, the solutionizing temperature may be 530° C. and the solutionizing time may be 2 hours. In another set of parameters, the solutionizing temperature may be, for example, in a range of 520° C.-540° C. and the time adjusted accordingly. It is noted that solutionizing temperature and time parameters are dependent in part on the material being solutionized (e.g., the specific alloy) as well as on one another. Thus, while representative temperatures and times may be provided herein that are alloy-specific, other parameters may be more suitable for other alloys.

In some forms, quenching the sintered powder metal component may involve water quenching the sintered powder metal component. However, it is contemplated that other types of quenching may also be suitable (e.g., oil quenching, air quenching, and so forth) in certain circumstances. In some forms, quenching the sintered powder metal component may involve quenching the sintered powder metal component to room or ambient temperature.

In some forms, between the step of solutionizing a sintered powder metal component and quenching the sintered powder metal component and the step of sizing the sintered powder metal component to form a sized powder metal component, the sintered powder metal component may be held in air at room temperature for a duration of time (for example, one hour). Thus, it need not be the case that the component goes immediately, with not delay, from the quench to the sizing.

The step of ageing can increase the hardness and strength of the sized powder metal component relative to the sized powder metal component prior to the step of ageing. In some forms, the step of ageing may include artificial ageing that occurs at an ageing temperature above ambient temperature over an ageing time. For example, in one instance, the ageing temperature may be 190° C. and the ageing time may be 12 hours. With 190° C. being used as an example (which again would be alloy dependent), it is contemplated that the ageing temperature could be, for example, in range of 180° C. to 200° C., with variances made to ageing time based on temperature and the desired amount of ageing. In some forms, the parameters of the ageing process may be selected such that the step of ageing involves ageing to peak hardness.

It is contemplated that the sized powder metal component could also be subjected to other post-sintering processes. For example, the sized powder metal component may have surfaces that are machined and/or shot peened to alter the properties of the surface (e.g., density, roughness, and so forth).

According to another aspect, a sized powder metal component made by any of the method described above is contemplated including various workable permutations of variances and modifications to the step. The sized powder metal component has improved fatigue strength by virtue of re-solutionizing the sized powder metal component after the step of sizing in comparison to an identical sized powder metal component that has been solutionized, sized, and aged without being additionally re-solutionized after having been sized.

According to yet another method, a method of manufacturing a sized powder metal component having improved fatigue strength is disclosed including the sequential steps of sizing a sintered powder metal component to form a sized powder metal component and solutionizing the sized powder metal component. Any of the more detailed aspects of the disclosure (e.g., subsequent ageing, pre-sizing solutionizing, materials employed and so forth) may be incorporated into this general method.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1:
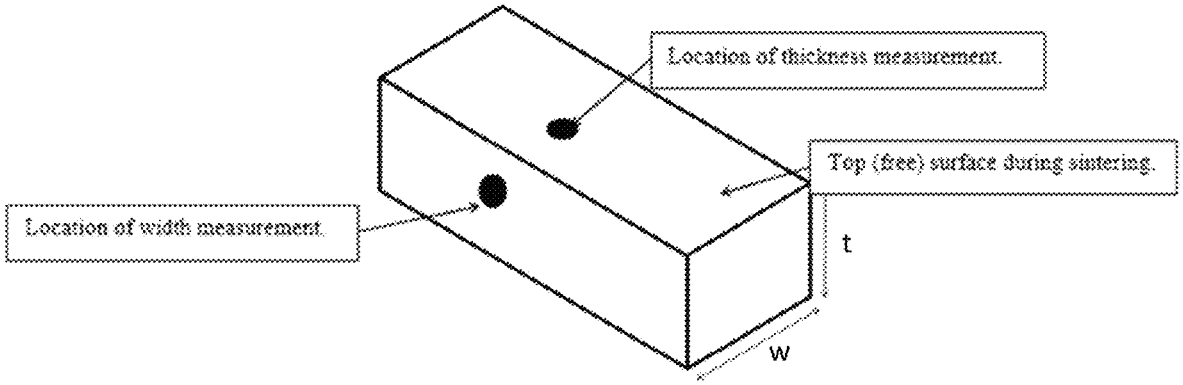
FIG. 1 is a schematic illustrating the geometry of a transverse rupture strength (TRS) bar used in various ones of the examples.

Disclosed herein are a method for producing powder metal components in which, after the component is compacted and sintered, the part is subsequently sized and subjected to a round of solutionizing (or, more accurately, re-solutionizing) after sizing. In some instances, the component may be solutionized and potentially aged before sizing (although an aged part is more liable to have poor response to plastic deformation during sizing) and then re-solutionized after sizing. For the sake of clarity, in reference to pre-sizing solutionizing, it is contemplated that the pre-sizing solutionizing may occur during sintering (thus not involving a separate post-sintering, but pre-sizing solutionizing step) and may be preserved by cooling the sintered parts relatively quickly in a water-cooled jacketed section of the sintering furnaces or may occur during a separate post-sintering, but pre-sizing solutionizing step followed by a quench. After the sizing and post-sizing solutionizing (or re-solutionization), the component can be artificially aged. Notably, by adding the post-sizing solutionizing (or re-solutionizing) step, the fatigue strength of the component is greatly increased. There can also be some enhanced effects provided by machining and/or peening the surfaces of the component.

Below, examples are provided for three different powder metal aluminum alloys. However, other alloys are contemplated as being workable within this improved method including other aluminum alloys and potentially alloys other than aluminum alloys.

The following examples are presented for illustrative purposes only, and are not intended to limit the scope of the present invention in any way.

EXAMPLES

To assess the effect of sizing, machining and shot peening on aluminum powder metal matrix composite (MMC) materials, studies were ran that primarily focused on the fatigue properties of the alloy with different post-sinter processing routes. Three different alloys were worked with, Al MMC-1, Al MMC-1A, and Alumix 431D, with all powder metals being from GKN Sinter Metals. Nominal compositions of these formulations are found in Table 1 below:

TABLE 1

Nominal Compositions of Powder alloys

| Element | Alumix 431D | Al-MMC-1 | Al-MMC-1A |
|---|---|---|---|
| Al | Balance | Balance | Balance |
| Cu | 1.5 | 3.0 | 3.0 |
| Zn | 5.5 | — | — |
| Mg | 2.5 | 1.5 | 1.5 |
| Sn | — | 0.6 | 0.6 |
| AlN | — | 0.5 | 0.2 |

Specific examples are now provided.

Example 1: Al MMC-1

Transverse rupture strength ("TRS") bars were pressed and sintered at GKN Sinter Metals from Al MMC-1 material and sent to Dalhousie University. Upon arrival, the sintered density was measured on five bars, with the results showing densities of 2.7175±0.004 g/cm$^3$.

Prior to any heat-treatment or sizing, the TRS bars were deburred using a polishing wheel and 320 grit sandpaper. The deburr was quite light—just enough to take the edge off all eight corners along the top and bottom faces of the bars with orientation parallel to the longitudinal axis.

Then four different sequences of sizing and heat treatment were considered, denoted SA, ZSA, SZA and SZSA in which each letter represented a processing step. "S" represented a solutionization/quench step (solutionization for 2 hours at 530° C. followed by quenching into room temperature water in the trials performed), "A" represented an artificial ageing step (ageing at 190° C. for 12 hours in the trials performed), and "Z" represented a sizing step. A 3% reduction in overall length (OAL) was targeted during all sizing operations.

It will be appreciated that the solutionizing temperature and time and the ageing temperature and time listed above are provided for example only based on the particular material that was used. One having ordinary skill in the art will understand that times and temperatures will be dependent on the particular material being heat treated or aged and, moreover, that there are ranges of temperatures and times that may be employed to achieve desired the particular results desired.

To summarize, the four different sequences of sizing and heat treatment that were considered:

TABLE 2

Al MMC-1 Treatment Descriptions

| Treatment | Description |
|---|---|
| SA | T6 treatment, solutionization with water quench into room temperature water followed by ageing |
| ZSA | T1 bars were sized followed by solutionization, quench in room temperature water and ageing |
| SZA | T1 bars were solutionized, quenched in room temperature water, held in air at room temperature for 1 hour, sized and aged |
| SZSA | T1 bars were solutionized, quenched in room temperature water, held in air at room temperature for 1 hour, sized, resolutionized, quenched and aged |

Sizing was completed in a closed tool set with the frame running under force control, meaning the bars could not be sized to 3% reduction in OAL directly. Bars sized in the T1 state (ZSA) were pressed to 380 MPa, which resulted in a reduction in OAL of 3.22±0.40% (with values ranging from 2.82-3.73%). Bars sized in the solutionized state (SZA and SZSA) were pressed to 270 MPa, resulting in a reduction in OAL of 3.34±0.42% (with values ranging from 2.79-4.03%).

Hardness measurements were made on four bars from each processing route. Each bar was measured in four locations, two on the top face and two on the bottom face, with the average results shown below:

TABLE 3

Al MMC-1 Hardness Results

| Process | Hardness (HRB) | St. Dev. |
|---|---|---|
| SA | 65.93 | 3.32 |
| ZSA | 66.08 | 2.84 |
| SZA | 68.45 | 4.59 |
| SZSA | 66.47 | 3.39 |

Although all hardness values fell within the standard deviations of the others, the SZA samples did show a higher average hardness value. This can be attributed to strain hardening in the surface of the bar caused by the sizing operation. This would be absent in the ZSA and SZSA samples due to the solutionization after sizing, which would cause recovery of the strain hardening. The ZSA and SZSA may have slightly higher hardness values due to an increase in density within the surface layer caused by sizing, but with the values being so close, this cannot be said for certain.

Next, fatigue testing was completed by the staircase method under 3-point bend loading using a servo hydraulic frame operated at 25 Hz with a runout value of 1,000,000 cycles, an R value of 0.1 and a sinusoidal loading curve.

With reference being made to FIG. 1, the bar thickness was measured in the center of the bar with a micrometer accurate to 0.001 mm. The width was measured in the center of the longitudinal direction, but close to the top sinter surface of the bar, again accurate to 0.001 mm. The length (distance between pins) was kept constant at L=24.7 mm.

The required force (P) to apply the desired level of tensile stress (σ) is given by:

$$P = \frac{2\sigma t^2 w}{3L}$$

The bar is placed in the 3-point bend fixture, with the top sinter surface down (i.e. in the orientation of maximum tensile stress). The fixture is moved so that the top pin is standing off by approximately 0.2 mm. The fixture is moved to bring the top pin in contact, applying 0.1 kN (≈3.7 MPa) at a rate of 0.01 kN/sec. Once the 0.1 kN load is stable the test is begun.

A step size of 5 MPa was used, with the fatigue strength (at 1,000,000) cycles being calculated based on MPIF Standard 56.

The following are the staircase curves that were generated for the four different processing routes. In all staircase curves, "x" indicates fail, while "o" indicates pass.

TABLE 4

Al-MMC-1A SA Staircase Curve

| | Bar Number | | | | | | | | | | | | | |
|---|---|---|---|---|---|---|---|---|---|---|---|---|---|---|
| Stress | 18 | 19 | 17 | 20 | 21 | 22 | 23 | 24 | 25 | 26 | 28 | 27 | 29 | 30 |
| 185 | | | x | | | | | | | | | | | |
| 180 | | ○ | | x | | x | | | | | | | | |
| 175 | ○ | | | | ○ | | x | | x | | | | | |
| 170 | | | | | | | | ○ | | x | | x | | |
| 165 | | | | | | | | | | | ○ | | x | |
| 160 | | | | | | | | | | | | | | ○ |

TABLE 5

Al-MMC-1 ZSA Staircase Curve

| | Bar Number | | | | | | | | | |
|---|---|---|---|---|---|---|---|---|---|---|
| Stress | 32 | 33 | 34 | 35 | 36 | 37 | 38 | 39 | 40 | 41 |
| 185 | | | | | x | | | | | |
| 180 | | | | ○ | | x | | x | | x |
| 175 | x | | ○ | | | | ○ | | ○ | |
| 170 | | ○ | | | | | | | | |

TABLE 6

Al-MMC-1 SZA Staircase Curve

| | Bar Number | | | | | | | | | |
|---|---|---|---|---|---|---|---|---|---|---|
| Stress | 53 | 54 | 55 | 56 | 57 | 58 | 59 | 60 | 61 | 62 |
| 140 | | | x | | x | | | | x | |
| 135 | | ○ | | ○ | | x | | ○ | | ○ |
| 130 | ○ | | | | | | ○ | | | |

TABLE 7

Al-MMC-1 SZSA Staircase Curve

| | Bar Number | | | | | | | | | | |
|---|---|---|---|---|---|---|---|---|---|---|---|
| Stress | 66 | 68 | 69 | 70 | 71 | 72 | 73 | 74 | 75 | 76 | 77 |
| 195 | | x | | | | | | | | | |
| 190 | ○ | | x | | x | | x | | | | |
| 185 | | | | ○ | | ○ | | x | | | |
| 180 | | | | | | | | | x | | |
| 175 | | | | | | | | | | x | |
| 170 | | | | | | | | | | | ○ |

TABLE 8

Al-MMC-1 Fatigue Strengths

| Process | $\sigma_a$ (10%) | $\sigma_a$ (50%) | $\sigma_a$ (90%) | St. Dev. | n | vs. SA |
|---|---|---|---|---|---|---|
| SA | 189.7 | 173.3 | 156.9 | 12.1 | 14 | — |
| ZSA | 191.3 | 177.5 | 163.7 | 10.0 | 10 | +2.4% |
| SZA | 155.5 | 136.3 | 117.0 | 13.9 | 10 | −21.4% |
| SZSA | 209.7 | 185.0 | 160.3 | 18.0 | 11 | +6.8% |

With respect to the column "vs. SA" in Table 8, above, which provides the percent change versus SA (T6) process, 50% passing strength used for calculations.

Interestingly, from the results above the SZA process showed a considerable decrease in fatigue strength when compared to the SA (or T6) processing route. This was quite a surprising result, as the sizing step was expected to increase the performance based on an increased densification in the surface of the bar. This is rather undesirable as this would likely be the preferred route of processing, both due to avoiding a solutionization and quench after sizing, which may cause difficulties in obtaining the dimensional tolerance required for production parts, and also, by sizing in the solutionized state when the material is more malleable than the T1 state (this may not be a concern depending on the capacity of the sizing press).

Example 2: Al MMC-1A

Tests were separately performed on the Al MMC-1A material. Tensile rupture strength ("TRS") bars were again pressed and sintered at GKN Sinter Metals and sent to Dalhousie University for testing. Upon arrival, the sintered density was measured on five TRS bars, with the results showing 2.7058±0.004 g/cm$^3$.

Bars were processed in a similar manner to Al MMC-1 samples, with four iterations added to look at the effects of machining, as well as peening. Table 9 below provides descriptions of the post-sinter processing for the various types of samples:

TABLE 9

Al MMC-1A Treatment Descriptions

| Treatment | Description |
|---|---|
| SA | T6 treatment, solutionization with water quench into room temperature water followed by ageing |
| ZSA | T1 bars were sized followed by solutionization, quench in room temperature water and ageing |
| SZA | T1 bars were solutionized, quenched in room temperature water, held in air at room temperature for 1 hour, sized and aged |
| SZSA | T1 bars were solutionized, quenched in room temperature water, held in air at room temperature for 1 hour, sized, resolutionized, quenched and aged |
| SZA-M | T1 bars were solutionized, quenched in room temperature water, held in air at room temperature for 1 hr, sized and aged. The four longitudinal faces were than machined off. |
| ZSA-M | T1 bars were sized followed by solutionization, quench in room temperature water and ageing. The four longitudinal faces were than machined off. |
| SZA-MP | T1 bars were solutionized, quenched in room temperature water, held in air at room temperature for 1 hr, sized and aged. The four longitudinal faces were than machined off and the top and side faces were peened. |
| ZSA-MP | T1 bars were sized followed by solutionization, quench in room temperature water and ageing. The four longitudinal faces were machined off, the top and side faces were than peened. |

For the Al MMC-1A samples, solutionization was slightly different than the Al MMC-1 samples, with solutionization being at 530° C. for 150 minutes total again with quenching into room temperature water. Ageing was again at 190° C. for 12 hours.

Bars sized in the T1 state (ZSA) were pressed to 300 MPa, which resulted in a reduction in OAL of 2.95±0.52% (with values ranging from 1.97-3.48%). Bars sized in the solutionized state (SZA and SZSA) were pressed to 180 MPa, resulting in a reduction in OAL of 3.33±0.27% (with values ranging from 2.99-3.78%).

Peening was completed with an automated system using a ceramic shot material ($ZrO_2$, 300 μm diameter). A peening intensity of 0.4 mmN was targeted, measured using Almen N-S strips. Intensity was measured before and after each batch of peening (SZA-MP and ZSA-MP), resulting in an Almen intensity of 0.417±0.006 mmN (ranging from 0.410-0.426 mmN). It should be noted that this intensity was selected as it has been seen to produce significant compressive residual stress within the surface of Alumix 431D while minimizing excessive damage to the specimen, but is not optimized for the alloy, meaning increased gains should be expected if optimized peening was found for Al MMC-1A.

Fatigue testing was completed similar to that of Al MMC-1, detailed above. The staircase method was utilized with the TRS bars loading in 3-point bending. Runout was set at 1,000,000 cycles, with a step size of 5 MPa, an R value of 0.1 and a sinusoidal loading curve. The following staircase curves were generated for the four processing routes.

TABLE 10

Al-MMC-1A SA Staircase Curve

| | Bar Number | | | | | | | | | |
|---|---|---|---|---|---|---|---|---|---|---|
| Stress | 59 | 60 | 61 | 62 | 63 | 64 | 65 | 66 | 67 | 68 |
| 200 | | | | | | x | | | | |
| 195 | | | | | ○ | | x | | | |
| 190 | | x | | ○ | | | | x | | ○ |
| 185 | ○ | | ○ | | | | | | ○ | |

TABLE 11

Al-MMC-1A ZSA Staircase Curve

| | Bar Number | | | | | | | | | |
|---|---|---|---|---|---|---|---|---|---|---|
| Stress | 24 | 25 | 26 | 27 | 28 | 29 | 30 | 31 | 32 | 33 |
| 190 | x | | x | | | | | | | |
| 185 | | ○ | | x | | x | | | | ○ |
| 180 | | | | | ○ | | x | | ○ | |
| 175 | | | | | | | | ○ | | |

TABLE 12

Al-MMC-1A SZA Staircase Curve

| | Bar Number | | | | | | | | | |
|---|---|---|---|---|---|---|---|---|---|---|
| Stress | 10 | 11 | 12 | 13 | 14 | 15 | 16 | 17 | 18 | 19 |
| 145 | | | | x | | | | | | |
| 140 | x | | ○ | | x | | | | x | |
| 135 | | ○ | | | | x | | ○ | | ○ |
| 130 | | | | | | | ○ | | | |

TABLE 13

Al-MMC-1A SZSA Staircase Curve

| | Bar Number | | | | | | | | | |
|---|---|---|---|---|---|---|---|---|---|---|
| Stress | 44 | 45 | 46 | 47 | 48 | 49 | 50 | 51 | 52 | 53 |
| 200 | | x | | | | x | | x | | |
| 195 | ○ | | x | | ○ | | ○ | | x | |
| 190 | | | | ○ | | | | | | ○ |

TABLE 14

Al-MMC-1A Fatigue Strengths

| Process | $\sigma_a$ (10%) | $\sigma_a$ (50%) | $\sigma_a$ (90%) | St. Dev. | n | vs. SA |
|---|---|---|---|---|---|---|
| SA | 197.4 | 190.8 | 184.3 | 4.7 | 10 | — |
| ZSA | 194.6 | 183.5 | 172.4 | 8.0 | 10 | −3.8% |
| SZA | 151.3 | 137.5 | 123.7 | 10.0 | 10 | −27.9% |
| SZSA | 212.0 | 195.5 | 179.0 | 11.9 | 10 | +2.5% |

Again, the "vs. SA" in Table 14 is the percent change versus the SA process pathway (T6), with 50% passing strength used for calculations.

Again, SZA samples show a drastic decrease in fatigue strength when compared to the SA samples. The ZSA and SZSA show similar strengths to the SA processing, although there does seem to be a slight increase in the SZSA processing of both the MMC-1 and 1A samples. This may be a result of the increased solutionization time with the SZSA process.

The underlying cause of this decrease in performance in the SZA processing is unknown, although it might be speculated as to what may be occurring.

The sizing step may be causing damage in the surface layer of the bar. This may result in small cracks developing prior to fatigue testing, which would result in areas where crack nucleation would occur very quickly, resulting in decreased fatigue performance. Although this may be having an effect, obvious damage has not been seen by optical micrographs when studying cross sections of a 7xxx series alloy (Alumix 431D), which shows similar trends in SZA and SZSA.

It is also possible that this is due to changes in the microstructure. Some literature suggests that in 7xxx series alloys, cold working between quench and ageing during heat treatment effects the precipitation formation within the microstructure. Although this was speculated as possibly contributing to the reduced strengths that have been observed in Alumix 431D, the MMC material is a 2xxx series, where a T8 temper is common, meaning this may not be playing a role.

However, perhaps the most likely cause of the decreased strength is residual stress. During SA, ZSA and SZSA the last process is a standard T6 heat treatment of solutionization, quench and artificial ageing (i.e., the "SA" terminal portions of the process). This results in compressive residual stresses within the surface of the part as a result of the quench step, caused by thermal gradients and different levels of contraction on the surface and inner material. This is beneficial during fatigue as the compressive residual stresses will oppose applied tensile forces (similar to the benefit of shot peening but to a lesser extent). During SZA processing, the material is heated for solutionization, and quenched, resulting in the compressive residual stresses, but the sizing which follows may be acting as a stress reliever (similar to stretching) which may be lowering or completely removing the beneficial compressive residual stresses (and may even be imparting tensile residual stresses). This is essentially a T8 temper consisting of solutionization, quench, cold working, and artificial ageing.

Example 3: Fracture Surfaces

Figure 2A:
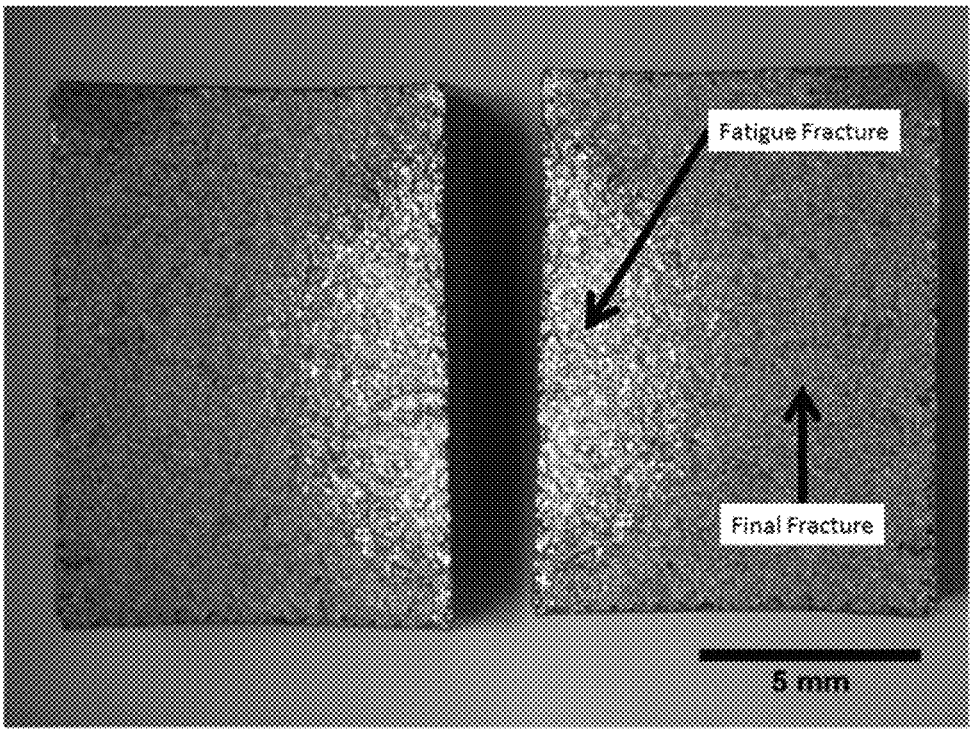
FIG. 2A is an image showing the fractured surfaces of a TRS bar processed using the SA process sequence (T6).
Figure 2B:
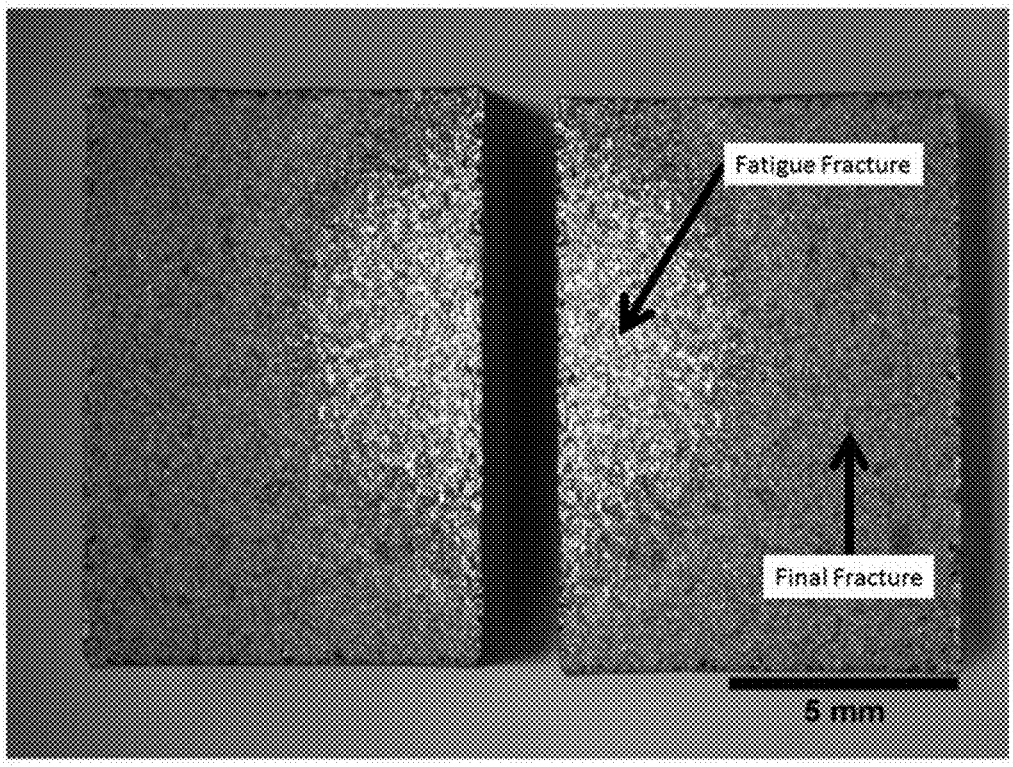
FIG. 2B is an image showing the fractured surfaces of a TRS bar processed using the ZSA process sequence described below.
Figure 2C:
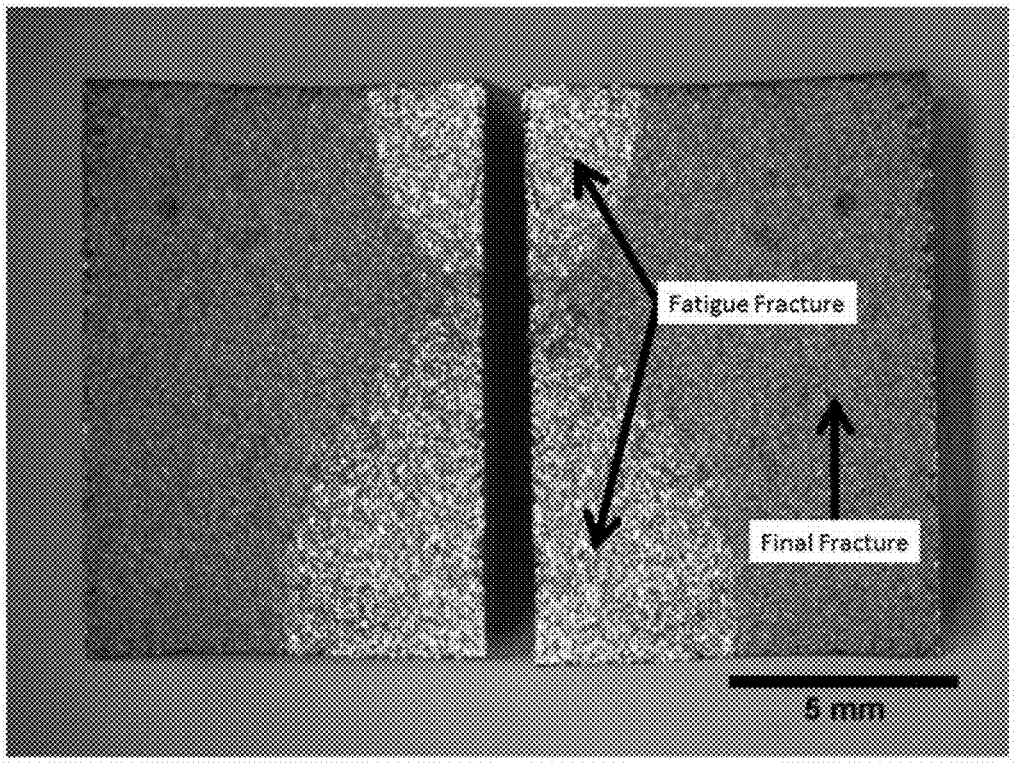
FIG. 2C is an image showing the fractured surfaces of a TRS bar processed using the SZA process sequence described below.

Now with reference to FIGS. 2A-2C, which are stereographic images the fracture surfaces of SA, ZSA, and SZA samples of the Al MMC-1 samples, respectively, the fracture surfaces of the SZA samples showed differences when compared to the other processing routes. Note that stereographic images of Al MMC-1A showed similar trends to the Al MMC-1 fracture. Although not provided, the SZSA samples showed similar fractures to SA and ZSA samples.

Interestingly, the SZA samples showed fracture initiating at the corners of the cross section, along the longitudinal edge of the bar. Based on linear elasticity, the maximum strain (and therefore stress) would exist in the center of the cross-section, leading to fracture initiating at the center of the bar. For the most part, this is what was seen in the SA, ZSA and SZSA samples (with the exception of a few samples initiating close to the edge, which likely indicate fracture initiating at a defect within the microstructure). There may be a few reasons why this would be occurring.

If there is damage accumulation during sizing, it would likely exist more so at the edges, where there does tend to be a bit of an elevation in the OAL due to shrinkage of the bars during sintering. As was mentioned, the de-burr was quite light which did not fully remove the variation in OAL of the bar across the width. This was also evident during sizing, where increased deformation along the edges was visible. If increased damage is present along the edge, it would make sense for crack nucleation to occur here.

Along the same lines, as there is increased deformation during sizing along the edges, if the sizing operation is relieving compressive residual stresses within the part, this would likely be more pronounced along the edge, where increased deformation is seen. This may make more sense, since damage accumulation would likely exist along the edges of the ZSA and SZSA bars if this was the leading cause of the reduced strength.

The fracture initiation along the edge may also be a result of the sharp corner acting as a stress raiser. Although this is also present in all other processing routes, the decreased strength may make the SZA samples more susceptible to failure occurring caused by the sharp corner.

Example 4: Effect of Machining

The staircase curves for the machined samples follow in the tables below.

TABLE 15

Al MMC-1A ZSA-M Staircase Curve

| | Bar Number | | | | | | | | | |
|---|---|---|---|---|---|---|---|---|---|---|
| Stress | 93 | 94 | 95 | 96 | 97 | 98 | 99 | 100 | 101 | 102 |
| 210 | | | | x | | x | | x | | x |
| 205 | x | | ○ | | ○ | | ○ | | ○ | |
| 200 | | ○ | | | | | | | | |

TABLE 16

Al MMC-1A ZSA-M Staircase Curve

| | Bar Number | | | | | | | | | |
|---|---|---|---|---|---|---|---|---|---|---|
| Stress | 125 | 126 | 128 | 129 | 130 | 131 | 132 | 133 | 134 | 135 |
| 185 | | | x | | | | x | | x | |
| 180 | | ○ | | x | | ○ | | ○ | | x |
| 175 | ○ | | | | ○ | | | | | |

TABLE 17

Al MMC-1A Fatigue strengths

| Process | $\sigma_a$ (10%) | $\sigma_a$ (50%) | $\sigma_a$ (90%) | St. Dev. | n | % change |
|---|---|---|---|---|---|---|
| ZSA | 194.6 | 183.5 | 172.4 | 8.0 | 10 | — |
| SZA | 151.3 | 137.5 | 123.7 | 10.0 | 10 | — |
| ZSA-M | 235.5 | 206.5 | 177.5 | 21.0 | 10 | +12.5% |
| SZA-M | 197.0 | 180.5 | 164.0 | 11.9 | 10 | +31.3% |

Figure 3A:
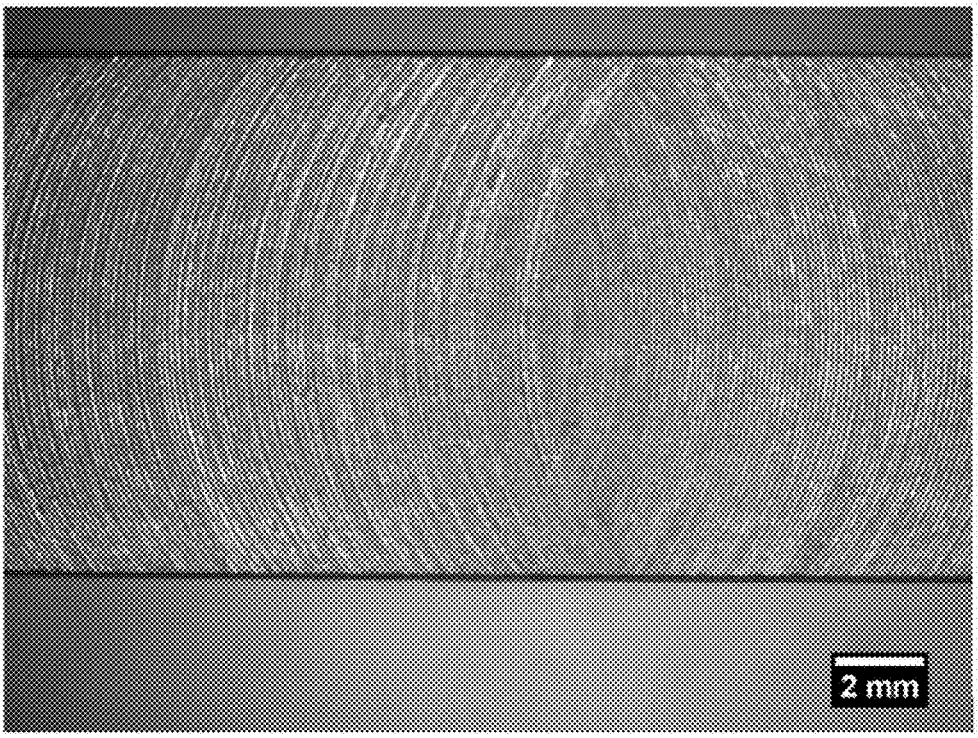
FIGS. 3A and 3B are images of machined TRS bars processed using the ZSA process prior to machining.
Figure 3B:
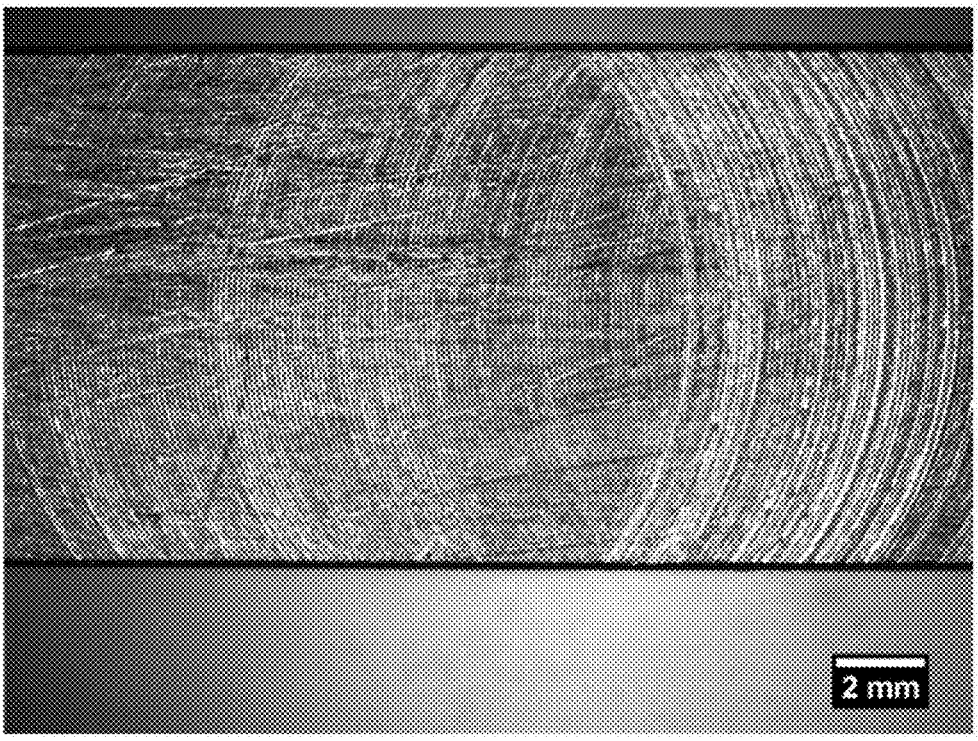

Interestingly, the machined samples (both with ZSA-M and SZA-M processing) showing considerable gains compared to the non-machined specimens, especially when considering the machining was quite aggressive. FIGS. 3A and 3B shows the machined surface of two ZSA samples.

The roughness (Ra) of ZSA samples was found to be 3.4±0.2 μm, while the ZSA-M samples was found to be 4.8±0.4 μm. Even with the rough machining, significant gains in strength were seen. This may be attributed to a reduced sinter quality on the surface of the bars. It is also interesting to note the SZA-M samples showed a more significant gain of approximately 31% compared to ZSA-M resulting in a gain of approximately 12%. This would indicate that the underlying cause of the decreased strength in the SZA samples is more pronounced in the surface of the specimen, this would be the case if either damage or residual stresses are a leading cause.

Example 5: Effect of Shot Peening

The staircase curves for the machined and peened samples follow in the tables below.

TABLE 18

Al MMC-1A ZSA-MP Staircase Curve

| | Bar Number | | | | | | | | | |
|---|---|---|---|---|---|---|---|---|---|---|
| Stress | 107 | 109 | 110 | 111 | 112 | 113 | 114 | 115 | 116 | 117 |
| 285 | | | | | | | | | | x |
| 280 | | | | | | | x | | ○ | |
| 275 | | | | | | ○ | | ○ | | |
| 270 | x | | x | | ○ | | | | | |
| 265 | | ○ | | ○ | | | | | | |

TABLE 19

Al MMC-1A ZSA-MP Staircase Curve

| | Bar Number | | | | | | | | | |
|---|---|---|---|---|---|---|---|---|---|---|
| Stress | 136 | 137 | 138 | 139 | 140 | 141 | 142 | 143 | 144 | 145 |
| 240 | x | | | | | | | | x | |
| 235 | | x | | | | x | | ○ | | ○ |
| 230 | | | x | | ○ | | ○ | | | |
| 225 | | | | ○ | | | | | | |

TABLE 20

Al MMC-1A Fatigue strengths

| Process | $\sigma_a$ (10%) | $\sigma_a$ (50%) | $\sigma_a$ (90%) | St. Dev. | n | % gain |
|---|---|---|---|---|---|---|
| ZSA-M | 235.5 | 206.5 | 177.5 | 21.0 | 10 | — |
| SZA-M | 197.0 | 180.5 | 164.0 | 11.9 | 10 | — |
| ZSA-MP | 279.0 | 267.5 | 256.0 | 8.3 | 10 | +29.5% |
| SZA-MP | 244.6 | 233.5 | 222.4 | 8.0 | 10 | +29.4% |

Both ZSA-M and SZA-M responded very well to peening, with gains close to 30% seen in both processing routes. Again, as was mentioned the peening intensity of 0.4 mmN was selected based on experience, increased gains should be possible by optimizing the process. One thing to note is that at elevated temperatures, the beneficial compressive residual stresses imparted by peening will begin to relax, resulting in lower fatigue strengths. SAE suggests limiting operating temperatures for aluminum alloys where shot peening is relied on to about 90° C.

Example 6: Comparative Hardness of Al MMC-1A

Hardness measurements were also collected for a group of Al MMC-1A samples. The specific TRS bars that were tested for hardness were different samples than the samples tested above. Again, tensile rupture strength ("TRS") bars were again pressed and sintered at GKN Sinter Metals and sent to Dalhousie University for testing. The respective bars for these hardness tests underwent the following four different sequences of sizing and heat treatment that we virtually identical to the bars tested in the Al MMC-1A tests above:

TABLE 21

Al MMC-1A Treatment Descriptions for Hardness Tests

| Treatment | Description |
|---|---|
| ZSA | Sized at 300 MPa, solutionized at 530° C. for 150 min (total), quenched in room temperature water, naturally aged for 24 hours and artificial age at 190° C. for 12 hours. |
| ZSA-M | Sized at 300 MPa, solutionized at 530° C. for 150 min (total), quenched in room temperature water, naturally aged for 24 hours and artificial age at 190° C. for 12 hours, longitudinal faces machined. |
| SZA | Solutionized at 530° C. for 150 min (total), quenched in room temperature water, 1 hour delay, size to 180 MPa, 24 hours natural age, and artificial age at 190° C. for 12 hours. |
| SZA-M | Solutionized at 530° C. for 150 min (total), quenched in room temperature water, 1 hour delay, size to 180 MPa, 24 hours natural age, and artificial age at 190° C. for 12 hours, longitudinal faces machined. |

Hardness measurements were made on 10-15 bars from each processing route. Each bar was measured with the average results shown below:

TABLE 22

Al MMC-1A Hardness Results

| Process | Hardness (HRB) | St. Dev. |
|---|---|---|
| ZSA | 58.56 | 3.98 |
| ZSA-M | 56.57 | 4.62 |
| SZA | 58.86 | 4.22 |
| SZS-M | 59.72 | 4.23 |

Although all hardness values fell within the standard deviations of the others.

Example 7: Fatigue Strength in Alumix 431D

Initial tests have also been run on bars prepared from Alumix 431D (available from Ecka Granules of Germany). Alumix 431D has, for example, 1.5 wt % Cu, 2.5 wt % Mg, 5.5 wt % Zn, 1 wt % wax with the balance of the powder being aluminum.

TRS bars were again prepared at GKN Sinter Metals and sent to Dalhousie University for fatigue testing. The samples that were prepared were subject to the following heat treatments:

TABLE 23

Alumix 431D Treatment Descriptions for Hardness Tests

| Treatment | Description |
|---|---|
| SA | Solutionized & Quenched; Aged to Peak Hardness |
| ZSA | Sized; Solutionized & Quenched; Aged to Peak Hardness |
| SZA | Solutionized & Quenched; Sized; Aged to Peak Hardness |
| SZSA | Solutionized & Quenched; Sized; Re-Solutionized & Quenched; Aged to Peak Hardness |
| ZSA-P | Sized; Solutionized & Quenched; Aged to Peak Hardness; Shot Peened |
| ZSA-M | Sized; Solutionized & Quenched; Aged to Peak Hardness; Machined |
| ZSA 80 C. | Sized; Solutionized & Quenched; Aged to Peak Hardness; Thermally Exposed at 80° C. for 1000 hours |
| ZSA-P 80 C. | Sized; Solutionized & Quenched; Aged to Peak Hardness; Shot Peened; Thermally Exposed at 80° C. for 1000 hours |
| ZSA-P 160 C. | Sized; Solutionized & Quenched; Aged to Peak Hardness; Shot Peened; Thermally Exposed at 160° C. for 1000 hours |

Fatigue strength tests were then run on these various samples. The same 3-point bend setup previously described was used again with a runout of 1,000,000 cycles and a frequency of 25 Hz. Table 24 below shows the calculated fatigue limit with a 50% chance of survival for each of the prepared samples and provides comparative percentile differences.

TABLE 24

Alumix 431D Percentage Differences in Fatigue Strengths

| | | Percentile Differences | | |
|---|---|---|---|---|
| Process | $\sigma_a$ (50%) | vs. T6 | vs. ZSA | vs. ZSA-P |
| SA (T6) | 217.5 | — | | |
| ZSA | 227.5 | 4.6 | | |
| SZA | 166.7 | −23.4 | | |
| SZSA | 234.2 | 7.7 | | |
| ZSA-P | 293.8 | 35.1 | 29.1 | |
| ZSA-M | 235.0 | 8.0 | 3.3 | |
| ZSA 80 C. | 224.5 | 3.2 | −1.3 | |
| ZSA-P 80 C. | 259.5 | 19.3 | 14.1 | −11.7 |
| ZSA-P 160 C. | 172.5 | −20.7 | −24.2 | −26.6 |

These results show that, for samples without additional machining or shot peening, the SZSA processed samples have the best fatigue strength, with an approximately 30% increase in fatigue strength over SZA processed samples (which omit the re-solutionizing step). As noted above in previous examples, the samples that are solutionized or re-solutionized after the sizing step exhibit improved fatigue strengths over samples that are not solutionized or re-solutionized after sizing. Again, given that a typical post-sinter process has been SZA for parts that need to be sized, the significant utility of post-sizing solutionization can be seen with fatigue strength going from a significant drop (−23.4% from the SA, T6 standard treatment) upon sizing followed directly by ageing to a modest increase (+4.6% for ZSA or +7.7% for SZSA) when post-sizing solutionization is employed.

The ZSA processed samples that were additionally machined or shot peened also exhibit improved fatigue strengths beyond the fatigue strengths of the non-machined or shot peened samples. The samples that were thermally exposed show the effect of thermal exposure on the degradation of the fatigue strength of the various ZSA samples, with the shot peened ZSA-P samples loosing significant amounts of fatigue strength after being thermal exposed (losing in excess of 10% fatigue strength from the non-thermally exposed ZSA-P samples), whereas the thermally exposed ZSA samples lose comparably less fatigue strength (only 1.3%) after thermal exposure to 80° C. for 1000 hours.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of manufacturing a sized powder metal component having improved fatigue strength over an otherwise identically-processed powder metal component that is not re-solutionized, the method comprising the sequential steps of:

solutionizing a sintered powder metal component comprising an aluminum alloy and quenching the sintered powder metal component;

sizing the sintered powder metal component to form a sized powder metal component;

re-solutionizing the sized powder metal component; and ageing the sized powder metal component.

2. The method of claim 1, wherein quenching the sintered powder metal component involves water quenching the sintered powder metal component.

3. The method of claim 1, wherein quenching the sintered powder metal component involves quenching the sintered powder metal component to ambient temperature.

4. The method of claim 1, wherein the sized powder metal component has surfaces that are machined.

5. The method of claim 1, wherein the sized powder metal component has surfaces that are peened.

6. The sized powder metal component made by the method of claim 1 in which the sized powder metal component has improved fatigue strength by virtue of re-solutionizing the sized powder metal component after the step of sizing in comparison to an identical sized powder metal component that has been solutionized, sized, and aged without being additionally re-solutionized after having being sized.

7. The method of claim 1, wherein, when compared to similar components that were just solutionized and aged according to a T6 treatment, the sized powder metal component subjected to the sequential steps of solutionizing, sizing, re-solutionizing, and ageing have an increase in fatigue strength of between 2.5% and 7.7%.

8. The method of claim 1, further comprising, before the step of solutionizing the sintered powder metal component, the steps of:

compacting a powder metal to form a powder metal compact; and sintering the powder metal compact to form the sintered powder metal component.

9. The method of claim 1, wherein one or both of the steps of solutionizing and re-solutionizing occur at a solutionizing temperature over a solutionizing time during which steps grains of the sintered powder metal component form a homogeneous solid solution.

10. The method of claim 1, wherein, between the step of solutionizing a sintered powder metal component and quenching the sintered powder metal component and the step of sizing the sintered powder metal component to form a sized powder metal component, the sintered powder metal component is held in air at room temperature for a duration of time.

11. The method of claim 1, wherein the step of ageing is artificial ageing that occurs at an ageing temperature above ambient temperature over an ageing time.

12. The method of claim 8, wherein the steps of compacting and sintering occur sequentially.

13. The method of claim 9, wherein the solutionizing temperature is 530° C. and the solutionizing time is 2 hours.

14. The method of claim 9, wherein the solutionizing temperature is in a range of 520° C.-540° C.

15. The method of claim 10, wherein the sintered powder metal component is held in air at room temperature for an hour.

16. The method of claim 11, wherein the ageing temperature is 190° C. and the ageing time is 12 hours.

17. The method of claim 11, wherein the ageing temperature is in a range of 180° C. to 200° C.

18. The method of claim 11, wherein the step of ageing increases the hardness and strength of the sized powder metal component relative to the sized powder metal component prior to the step of ageing.

19. The method of claim 18, wherein the step of ageing involves ageing to peak hardness.

* * * * *